United States Patent [19]

Phillips

[11] 4,054,008

[45] Oct. 18, 1977

[54] AUTOMATIC DOOR OPENING ARRANGEMENT

[75] Inventor: Richard Edwin Phillips, Vancouver, Canada

[73] Assignee: R. E. Phillips Limited, Vancouver, Canada

[21] Appl. No.: 670,514

[22] Filed: Mar. 24, 1976

[51] Int. Cl.[2] ..... E05F 15/20

[52] U.S. Cl. ..... 49/31; 49/2; 49/141

[58] Field of Search ..... 49/1, 2, 31, 32, 141, 49/153

[56] References Cited

U.S. PATENT DOCUMENTS

| | | | |
|---|---|---|---|
| 3,354,581 | 11/1967 | Dimmitt et al. | 49/141 |
| 3,445,963 | 5/1969 | Gilbert et al. | 49/141 |
| 3,908,309 | 9/1975 | Coulter et al. | 49/2 |

*Primary Examiner*—Peter M. Caun

*Attorney, Agent, or Firm*—Beveridge, DeGrandi, Kline & Lunsford

[57] ABSTRACT

An automatic opening smoke vent door is provided which serves as a normal, self-closing exit door, and which is capable of being connected to a fire alarm circuit so that the door opens automatically in the event of a fire to allow smoke to be vented. The invention provides a member, preferably an L-shaped sub-frame, hinged to the normal door frame, and with an opening device acting between the door frame and the hinged member to urge this member from a closed position to an open position disposed at about 90° to the door frame. The hinged member is normally held in the closed position by a solenoid operated latch, which is released to allow the member to open in the event of a fire. The door is itself hinged to the hinged member, and a normal door closer is connected between the hinged member and the door to allow the door to operate in the usual way when the hinged member is in the closed position.

4 Claims, 4 Drawing Figures

AUTOMATIC DOOR OPENING ARRANGEMENT

Figure 2:
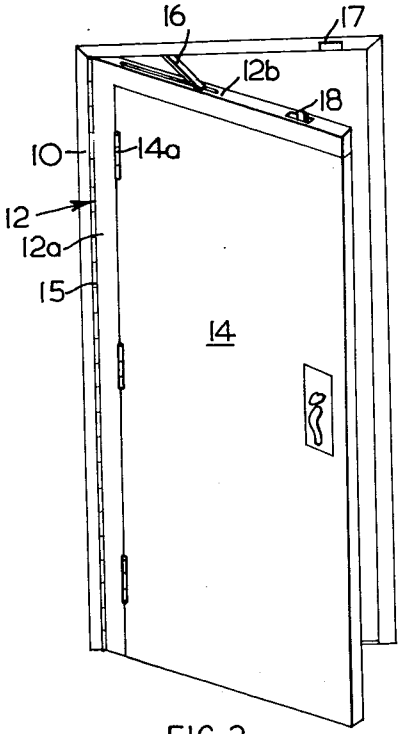

The present invention relates to an automatic emergency door opening arrangement, and in particular provides a door mounting arrangement which provides automatic opening of the door in the event of fire.

New regulations for high rise buildings include provisions for venting smoke from stairwells. These include large ventilating fans which pull fresh air into the stairwell, and doors (so called smoke vent doors) which open from the stairwell to the exterior of the building and which are arranged to open automatically in a fire situation.

One presently known arrangement for smoke vent doors is a normal door and frame with a reversed door closer that will push the door open. This door is held in the closed position by an electric magnetic lock. Normal exit from this door is by pushing a panic device which de-energizes the magnetic lock and allows the door to open. This door will not self-close and lock, as is desirable with exit doors, and power failure or lapse will cause the door to open.

Another proposed arrangement is to use an automatic door operator which will allow the door to open automatically, and then close, when someone activates the panic device. This provides automatic door closing. However, such a door operator has a lot of relays, solenoids, etc., which are expensive to install and maintain, and which might be unreliable in an emergency situation.

The present invention provides a smoke vent door, or an arrangement for mounting such door, which allows the door to open automatically in the presence of a signal from a fire detector unit or whatever other kind of signal may be used. The door can be closed in the usual way on cessation of the signal. In the absence of any signal, the door operates as a normal emergency exit door and is self-closing. The cost of the arrangement in accordance with this invention is much less than with automatic door operators of the type referred to above.

In accordance with one aspect of the present invention, there is provided an arrangement for mounting an emergency door, comprising a door frame and a member hinged to the door frame. An opening device acts between the door frame and the member to urge the member from a closed position in which it is aligned with the door frame, to an open position, and a retaining device fixed to the door frame normally holds the hinged member in its closed position, but is releasable on receipt of an electrical signal to allow the opening device to move the member to its open position. A door of conventional type may be hingedly connected to the door frame, either directly or indirectly via a portion of the hinged member, and the conventional latching and automatic closing arrangement of such a door can engage with the hinged member, rather than with the door frame. In normal situations, the hinged member remains in the closed position, held by the retaining device, but the door itself can be opened in the usual way and is self-closing. The door and hinged member have interengaging parts which cause the door to be opened when the hinged member is moved to the open position by the opening device, on release of the retaining device.

The hinged member is preferably an L-shaped sub-frame set into the door frame, and having vertical and horizontal legs, the longer, vertical leg being hinged to the vertical portion of the door frame, and the door being in turn hinged to this vertical leg. The horizontal leg of the sub-frame is attached to the opening device and is engageable in its closed position with the retaining device.

Figure 1:
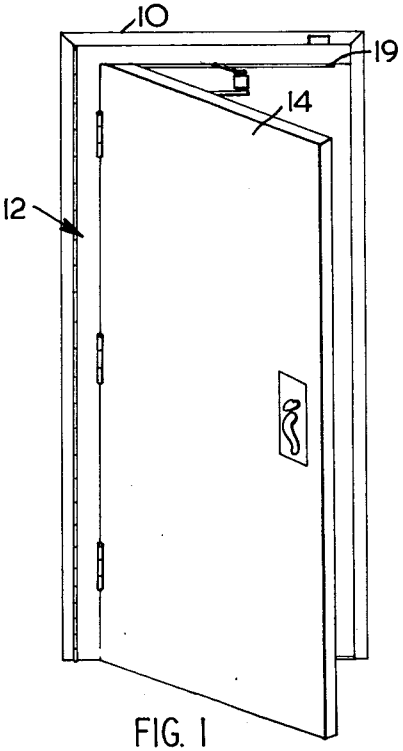
Figure 3:
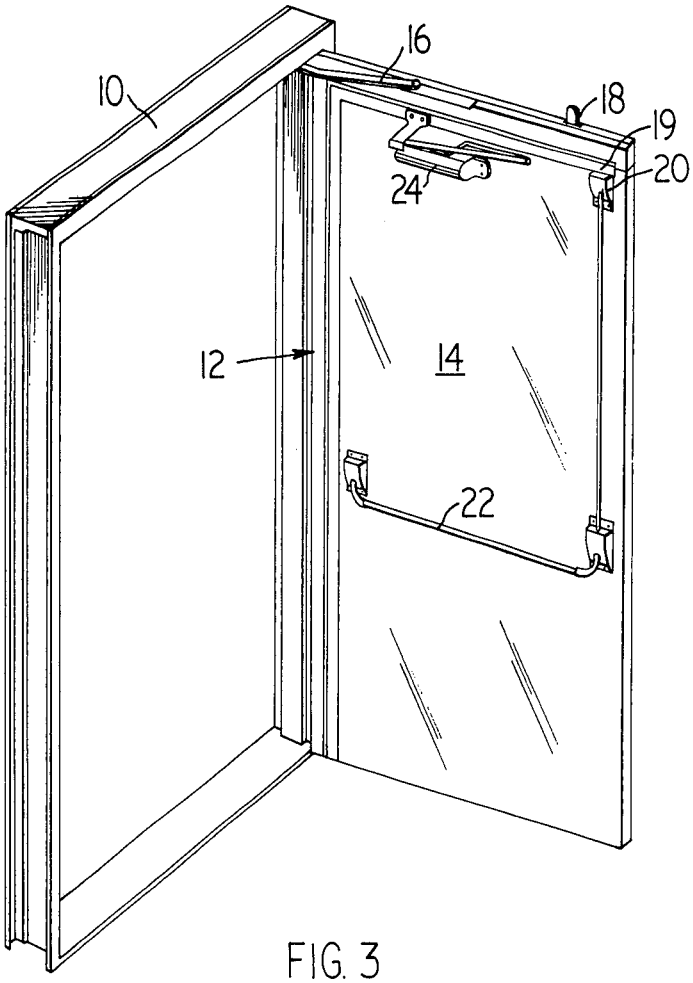
Figure 4:
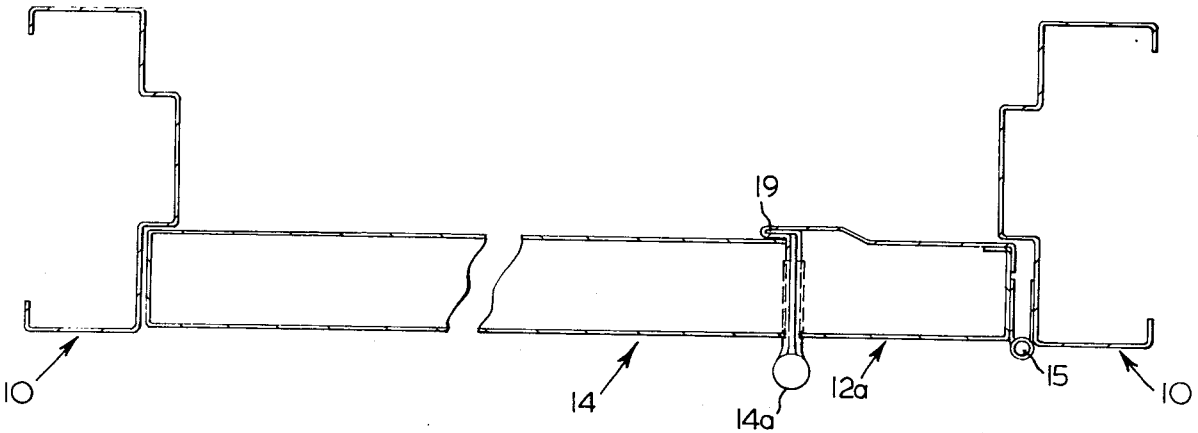

In the accompanying drawings showing a preferred embodiment of this invention:

FIG. 1 shows a perspective view of a door and frame assembly with the door being opened in normal (non-emergency) manner, FIG. 2 is a similar view showing the door in the process of being opened automatically as in an emergency, FIG. 3 shows a rear view of the door in its fully open position, and FIG. 4 is a cross-sectional plan view through the (closed) door and frame.

The drawings show a fixed door frame 10, having a doorway therethrough and within which doorway may be hingedly supported an L-shaped sub-frame 12, and a door 14. All these parts are of hollow sheet metal construction, the cross-sectional form of which is shown in FIG. 4.

The sub-frame 12 is an L-shaped metal member of rectangular cross section with mutually perpendicular vertical and horizontal legs **12*a* and 12*b* respectively, sized so that the sub-frame fits within the door frame 10 and closely surrounds the two adjacent sides of the door 14. The vertical leg 12*a* is hinged along its outside to the frame 10 by a continuous hinge 15 which allows movement of the sub-frame from a closed position, flush with the door frame, to an open position at 90° to the door frame. The upper horizontal leg 12*b* is connected to the top of the door frame 10 by a concealed door closer 16 which is of known form but which is connected in a reverse manner so as to act as an opening device, in accordance with the invention, and so as to normally urge the sub-frame to its open position. Normally, however, the sub-frame is held closed by a retaining device constituted by a solenoid operated catch 17 which forms part of a special electrical strike plate and which acts to retain a lug 18 fixed to the sub-frame. The solenoid of the retaining device is normally connected into a fire detection circuit, or any similar circuit which receives a signal in an emergency situation, so as to release the lug 18 in such emergency situation. The catch 17 and lug 18 are such that when the solenoid is de-energized the catch is self-latching onto the lug 18** on closure of the sub-frame.

The door 14 is hinged by conventional hinges 14a within the sub-frame 12. Interengaging means are provided to prevent movement of the door in the closing direction beyond the plane of the sub-frame so that the door is caused to move with the sub-frame when this is opened by the "closer" 16. These interengaging means are constituted by a flange 19 formed integrally with the casing of sub-frame 12 and projecting behind the associated margins of door 14. As seen in FIG. 3, a conventional latching mechanism 20, with a panic opening bar 22, connects the door and the sub-frame, so as to retain the door normally closed. Also, a conventional door closer 24 connects the door and the sub-frame.

In a normal situation, the sub-frame 12 is held by retaining device 17, and the door is used normally by means of the latch 22, being self-closed by the closer 24. When a signal is received at the device 17, this releases the lug 18 and the "closer" 16 acts to open the sub-frame and with it the door 14. The door and sub-frame can be closed, and the device returned to its normal condition, after cessation of a signal, by reason of the self-latching nature of catch 17 and lug 18.

The power requirement of this device is only about 3.0 amps or less for the solenoid catch 17.

Failure of the power supply will not prevent opening of the door in the usual way, and yet will not cause any undesired opening of the exit door.

Although the use of an L-shaped sub-frame is preferred, this is not essential. While the vertical leg of this sub-frame acts as a convenient mounting for the door, it can be envisaged that a simple hinged member could be used, generally corresponding to leg 12b of the sub-frame, and acting in the same manner as described, and with the door directly hinged to the stationary frame 10.

Applicant is aware, through searches, of U.S. Pat. No. 3,805,449 which issued on Apr. 23, 1974 to Bogaert. This is concerned with a device for automatically opening a skylight. The arrangement described in this prior patent does use a sub-frame, but the arrangement is essentially different from that of the present invention, one difference being that the solenoid operated latch is mounted on the sub-frame, rather than on a fixed frame, thus requiring electrical connections to be made to a movable frame. Furthermore, there is no suggestin of how the skylight could be automatically closed.

I claim:

1. In a frame providing a doorway therethrough and having a door therefor, the improvement comprising an emergency arrangement for automatic opening of said door from said doorway to permit ingress and egress through said doorway, said arrangement including means for hingedly supporting said door within said doorway in a closed position of alignment with said frame of said doorway and in a manner to open from said doorway by hinged movement thereof in a given direction with respect to said doorway, a member hingedly supported within said doorway in a closed position of alignment with the frame of said doorway and said door and in a manner to open from said doorway on hinged movement thereof in the same said given direction as that by which said door hingedly moves to open from said doorway, said member having means engageable with said door for preventing hinged movement of said door with respect thereto other than in said given direction of hinged movement thereof by which said door moves to open from said doorway, said door being otherwise mounted for hinged opening and closure thereof independent of said member, latch means for releasable latching interconnection of said door with said member in a closed position of alignment therewith, an opening device acting between the frame of said doorway and said member to urge said member from a closed position in which said member is aligned with the frame of said doorway to a position open from said doorway, a retaining device mounted on the frame of said doorway and interengageable with and normally holding said member in a closed position of alignment with the frame of said doorway and releasable from interengagement with said member on receipt of a given signal and thereby permitting said opening device to urge said member from a closed position of alignment with the frame of said doorway to a position open from said doorway, said means of said member engageable with said door for preventing hinged movement of said door with respect thereto other than in said given direction of hinged movement thereof by which said door moves to open from said doorway acting to cause said door to open from said doorway as said member moves to an open position from said doorway and preventing closure of said door to a closed position of alignment with the frame of said doorway so long as said member is open from said doorway.

2. An arrangement according to claim 1, wherein said member is L-shaped, having two mutually perpendicular legs, a first of said legs being hinged along an outer side thereof to the door frame and suitable for carrying said door hinged to the inner side thereof, said first leg having a length equal to the inside of the door frame, and the other of said legs being attached to said opening device and being engageable in the closed position with said retaining device.

3. An arrangement according to claim 1, wherein said retaining device is a catch arranged to be released by a solenoid.

4. An arrangement according to claim 1, wherein said door and member are connected by a door closer which operates to close said door in normal operation thereof, when said member is held in its closed position.

* * * * *

UNITED STATES PATENT OFFICE

CERTIFICATE OF CORRECTION

Patent No. 4,054,008 Dated October 18, 1977

Inventor(s) Richard Edwin Phillips

It is certified that error appears in the above-identified patent and that said Letters Patent are hereby corrected as shown below:

On Title Page, add

--[30] Foreign application priority data

March 1, 1976...Canada...246,811 --.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*